United States Patent [19]

Morand

[11] Patent Number: 5,058,792

[45] Date of Patent: Oct. 22, 1991

[54] BATHROOM TISSUE DISPENSER (LARGE ROLL)

[75] Inventor: Michel Morand, Montreal, Canada

[73] Assignee: Wyant & Company Limited, Lachine, Canada

[21] Appl. No.: 503,866

[22] Filed: Apr. 3, 1990

[51] Int. Cl.[5] ..... B65H 35/10

[52] U.S. Cl. ..... 225/42; 225/47; 225/52; 225/53

[58] Field of Search ..... 225/42, 46, 47, 52, 225/53, 54, 77, 44, 45

[56] References Cited

U.S. PATENT DOCUMENTS

| | | | |
|---|---|---|---|
| 1,415,722 | 5/1922 | Silverman | 225/47 |
| 2,416,115 | 2/1947 | Neuman | 225/42 |
| 2,541,222 | 2/1951 | Egart et al. | 225/42 |
| 2,565,994 | 8/1951 | Sevenich . | |
| 3,523,653 | 8/1970 | Hansen . | |
| 3,923,223 | 12/1975 | Larsson et al. | 225/46 |
| 4,579,266 | 4/1986 | Bünger et al. | 225/19 |
| 4,796,832 | 1/1989 | Shutz et al. | 242/55.3 |
| 4,872,601 | 10/1989 | Sigmund | 225/38 |

FOREIGN PATENT DOCUMENTS

| | | | |
|---|---|---|---|
| 2063213 | 6/1981 | United Kingdom | 225/42 |

*Primary Examiner*—Frank T. Yost
*Assistant Examiner*—John M. Husar
*Attorney, Agent, or Firm*—Larson and Taylor

[57] ABSTRACT

A large roll toilet paper dispenser having means for dispensing the toilet paper in a twice folded-over condition to strengthen the paper. The twice folded-over dispensed paper permits thinner paper to be used. The dispenser can also have means for minimizing bunching of the paper while it is being dispensed so that it can be easier to tear. The dispenser further has means making it easier to dispense the paper. These means can include means for locating the paper outlet opening in a more accessible position, and means for making the locating of the paper end easier.

14 Claims, 6 Drawing Sheets

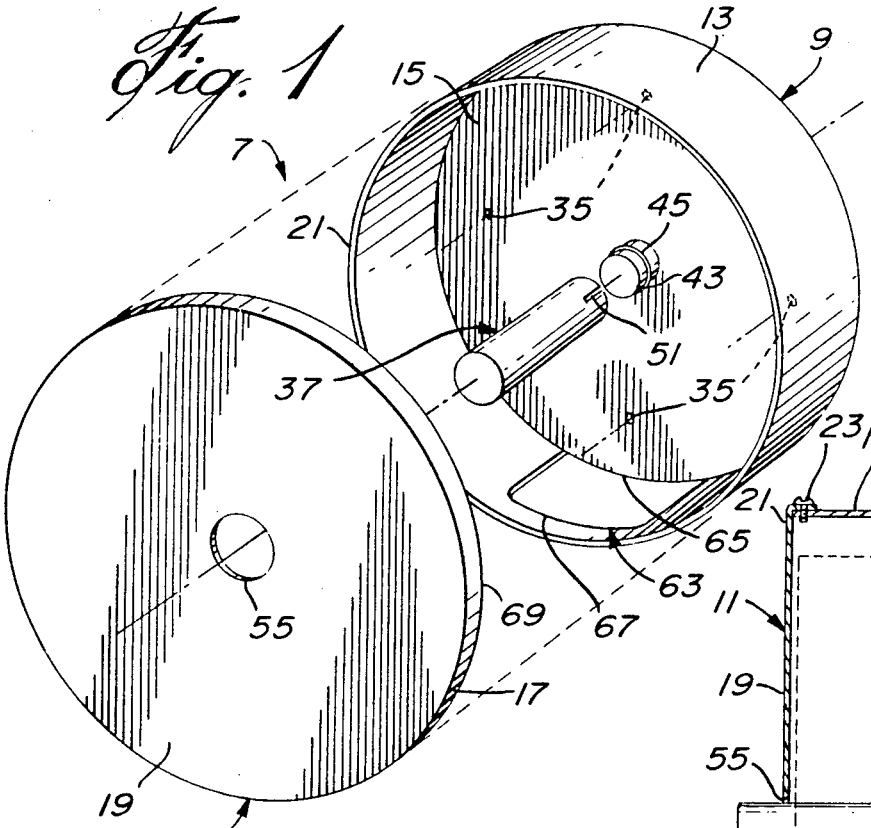
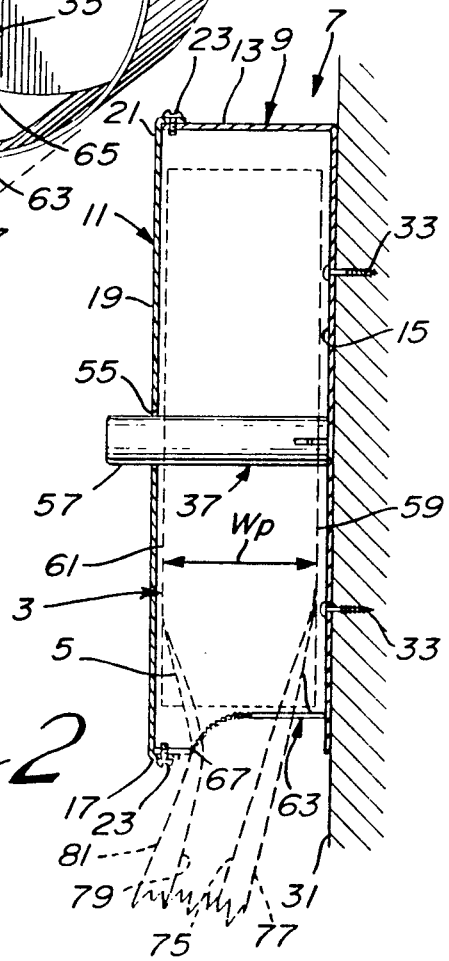
Fig. 2
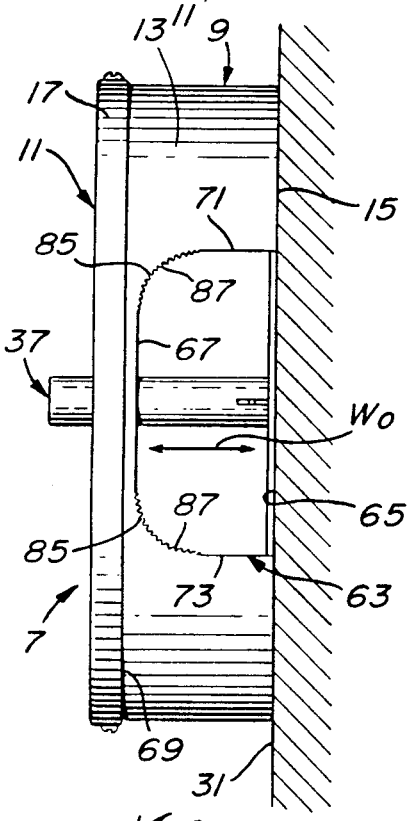
Fig. 4
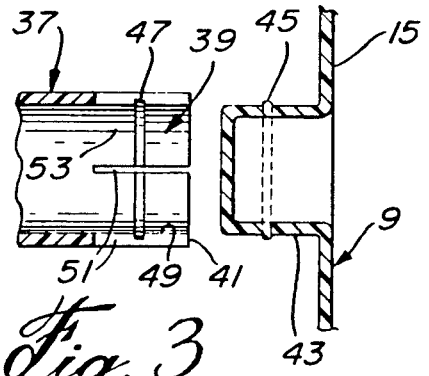
Fig. 3

BATHROOM TISSUE DISPENSER (LARGE ROLL)

This invention is directed toward an improved paper dispenser.

The invention is more particularly directed toward an improved toilet paper dispenser having means for improving the dispensing of the toilet paper off a roll, and specifically from a large roll of toilet paper.

There are many minor problems present in dispensing toilet paper from rolls mounted in a dispenser. Often, the toilet paper, when it is pulled from the dispenser, will bunch in a corner of the outlet opening of the dispenser making it difficult to tear. When the bunched paper is torn, it often splits longitudinally toward the roll, located within the dispenser, and it is difficult to find a suitable end of the paper within the outlet opening of the dispenser for further dispensing. Another problem, even without split ends, is to find the end of the paper within the outlet opening of the dispenser in order to withdraw it from the dispenser. A further problem is in having the outlet opening of the dispenser located closely adjacent to the support wall that the dispenser is mounted on. This again makes it awkward to find and with draw the end of the paper.

Known toilet paper dispensers also are often complicated in construction with a number of separate parts, particularly with respect to the spindle on which a roll is mounted, and the mounting of the spindle in the housing of the dispenser. If the spindle is in any way damaged during use, replacement is often difficult, involving removal of the housing from its mounted position on the support wall.

The above problems exist with dispensers handling ordinary rolls of toilet paper. The problems are often more acute with dispensers handling large rolls of toilet paper. More and more large rolls of toilet paper are now being used since they last longer and therefore not as much service work is required in refilling the dispenser. By a large roll, it is meant a roll about eleven inches in diameter. As a large roll gets used up it is more difficult to find the end of the roll within the larger dispenser. This is particularly true if the end splits during tearing due to bunching. The larger dispenser required also makes it more awkward to reach the end of the paper particularly when the outlet opening is against the support wall on which the dispenser is mounted.

A further problem with large rolls is that it is difficult to use thin paper. Thin paper tends to tear easily when being pulled off large rolls because of the greater inertia of large rolls. Normally, during dispensing, the toilet paper is pulled from the dispenser at an angle in a direction away from the support wall the dispenser is mounted on. Pulling the paper off at an angle automatically causes the side of the paper closest to the support wall, to move away from the wall to fold over. This first fold formed in the paper during dispensing strengthens it. However even with the paper normally once folded over during dispensing, thin paper still tears when being pulled off the roll.

It is the purpose of the present invention to provide a toilet paper dispenser that avoids or at least minimizes the above dispensing problems. More particularly, it is the purpose of the present invention to provide a toilet paper dispenser that makes it easier to dispense thin paper off large rolls. It is also a purpose of the present invention to provide a toilet paper dispenser that minimizes bunching of the toilet paper while dispensing. It is another purpose of the present invention to provide a toilet paper dispenser that makes it easier to find the free end of the toilet paper for dispensing. It is a further purpose of the present invention to provide a toilet paper dispenser that makes it easier to dispense toilet paper.

It is still a further purpose of the present invention to provide a toilet paper dispenser that is simple in construction and operation, and easily serviced.

In accordance with the present invention there is provided a toilet paper dispenser that includes means for automatically putting a second fold in the toilet paper while it is being dispensed off a roll mounted on the dispenser. The second fold is formed when the other side of the paper, furthest from the support wall, is guided toward the support wall to fold over during dispensing. Thus the paper dispensed has two folds in it making it much stronger than a once folded paper. The twice-folded paper permits thinner paper to be used on the roll. This is particularly important when the roll is a large roll. Thinner paper can be used on a large roll with less likelihood of it tearing when it is pulled off the roll if the paper is twice-folded over on itself during dispensing.

In addition in accordance with the present invention, a toilet paper dispenser is provided which is mounted at a slant to the mounting surface, to reduce the weight and friction on the paper being dispensed thus reducing the likelihood of it tearing when it is pulled off the roll.

Also in accordance with the present invention there is provided a toilet paper dispenser having means minimizing bunching of the paper in a corner of the outlet opening in the dispenser during dispensing. These means comprise providing gently rounded corners in the outlet opening where bunching normally occurs. The rounded corners tend to spread out the paper minimizing the bunching effect and making it easier to tear the paper without splitting. Preferably, the rounded corners are provided with cutting teeth making it easier to tear the paper in the corners.

Further in accordance with the present invention, a toilet paper dispenser is provided with means making it easier to dispense the paper. These include means making it easier to locate and grasp the free end of the paper within the outlet opening of the dispenser. These locating means include providing a housing for the roll of paper that locates the outlet opening away from the wall on which the dispenser is mounted. These locating means can also include means providing a view of the end of the paper adjacent the outlet opening.

The means making it easier to dispense the paper also include providing a spindle for mounting the roll within the dispenser with the spindle accessible and manually rotatable from outside of the dispenser to position the end of the paper where it is readily accessible. Preferably, the spindle is also eccentrically mounted within the dispensing housing, above the central axis of the housing, making it easier for the paper to slide off the roll.

In accordance with the present invention there is also provided a toilet paper dispenser with a minimum number of parts making it simple to assemble and repair. More particularly there is provided a toilet paper dispenser having detachable connecting means integral with the housing and spindle making it a simple matter to connect the spindle to the housing and to replace it.

The invention is particularly directed towards a dispenser for a roll of toilet paper having: a housing for a roll with first and second spaced-apart, generally parallel, endwalls and a sidewall extending between the endwalls. The dispenser is adapted to be mounted on a vertical surface with the first endwall adjacent the surface. A spindle is rotatably mounted on one of the endwalls within the housing. The housing is made in two parts, one detachable from the other, to allow mounting of the roll on the spindle. An outlet opening is provided in the sidewall through which the toilet paper is dispensed off the roll. The side of the outlet opening nearest the second endwall is located here to fold the side of the paper adjacent the second endwall during dispensing.

The invention is also directed towards a dispenser for a roll of toilet paper having: a housing for a roll with first and second spaced-apart, generally parallel, endwalls and a sidewall extending between the endwalls. The dispenser is adapted to be mounted on a vertical surface with the first endwall adjacent the surface. A spindle is rotatably mounted on one of the endwalls within the housing. The housing is made in two parts, one detachable from the other, to allow mounting of the roll on the spindle. An outlet opening is provided in the sidewall through which the toilet paper is dispensed off the roll. The outlet opening has two spaced-apart, generally parallel end edges either of which can be used to tear the dispensed paper. Each end edge terminates at a gently rounded corner at the end where bunching of the toilet paper tends to occur.

The invention is further directed towards a dispenser for a roll of toilet paper having: a housing for a roll with first and second spaced-apart, generally parallel, endwalls and a sidewall extending between the endwalls. The dispenser is adapted to be mounted on a vertical surface with the first endwall adjacent the surface. A spindle is rotatably mounted on one of the endwalls within the housing. The housing is made in two parts, one detachable from the other, to allow mounting of the roll on the spindle. An outlet opening is provided in the sidewall through which the toilet paper is dispensed off the roll. Means are provided on the first endwall for mounting the housing at a slant on the vertical surface to space the outlet opening from the surface.

The invention is further directed towards a dispenser for a roll of toilet paper having: a housing for a roll with first and second spaced-apart, generally parallel, endwalls and a sidewall extending between the endwalls. The dispenser is adapted to be mounted on a vertical surface with the first endwall adjacent the surface. A spindle is rotatably mounted on one of the endwalls within the housing. The housing is made in two parts, one detachable from the other, to allow mounting of the roll on the spindle. An outlet opening is provided in the sidewall through which the toilet paper is dispensed off the roll. The spindle has a portion projecting through the other endwall to permit the spindle to be manually rotated to dispense paper off the roll.

The invention is still further directed towards a dispenser for a roll of toilet paper having: a housing for a roll with first and second spaced-apart, generally parallel, endwalls and a sidewall extending between the endwalls. The dispenser is adapted to be mounted on a vertical surface with the first endwall adjacent the surface. A spindle is rotatably mounted on one of the endwalls within the housing. The housing is made in two parts, one detachable from the other, to allow mounting of the roll on the spindle. An outlet opening is provided in the sidewall through which the toilet paper is dispensed off the roll. The endwalls are substantially circular and the spindle is mounted on an axis that is offset from the axis defining the center of the endwalls.

The invention is also directed towards a dispenser for a roll of toilet paper having: a housing from a roll with first and second spaced-apart, generally parallel, endwalls and a sidewall extending between the endwalls. The dispenser is adapted to be mounted on a vertical surface with the first endwall adjacent the surface. A spindle is rotatably mounted on one of the endwalls within the housing. The housing is made in two parts, one detachable from the other, to allow mounting of the roll on the spindle. An outlet opening is provided in the sidewall through which the toilet paper is dispensed off the roll. Integral mounting means are provided on the one endwall and the spindle for use in detachable connecting them together.

The invention will now be described in detail having reference to the accompanying drawings in which:

FIG. 1 is an exploded, schematic view of one embodiment of the dispenser;

FIG. 2 ia a cross-section view of the dispenser mounted on a support wall;

FIG. 3 is a detailed, cross-sectional view of the spindle mounting;

FIG. 4 is a bottom view of the dispenser when mounted on a wall;

Figure 5:
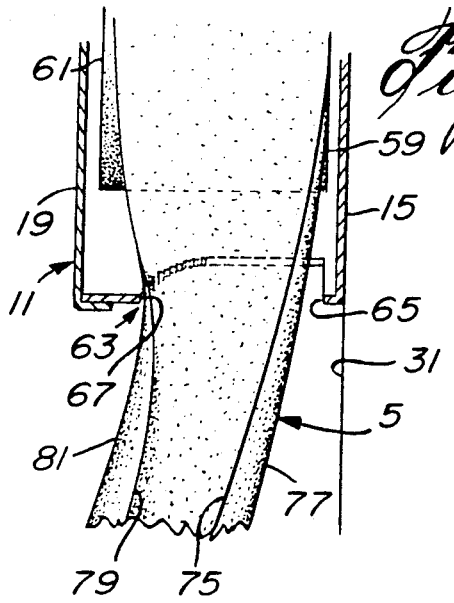
FIG. 5 is a detailed, cross-sectional view showing toilet paper being dispensed from the dispenser.

The dispenser of the present invention, as shown in FIGS. 1 and 2, is designed to hold and dispense a large roll 3 of toilet paper 5. By a "large" roll it is meant a roll about eleven inches in diameter. In its simplest embodiment, the dispenser has a housing 7 within which the roll 3 is mounted. The housing 7 is in two sections and comprises an open base 9 and a detachable cover 11 that normally closes the base 9. The base 9 has curved sidewall 13 and a first, flat endwall 15 closing one side of the sidewall 13. The sidewall 13 is preferably cylindrical and the endwall 15 is generally circular. The cover 11 closes the other open side of the base 9 and has a narrow, curved sidewall 17 and a second flat endwall 19 closing one side of the sidewall 17. The sidewall 17 is also cylindrical and the endwall 19 is generally circular. With the cover 11 in its closed position, its second endwall 19 is parallel to the first endwall 15 of the base 9, and its narrow sidewall 17 overlies the sidewall 13 of the base 9. The free edge 21 of the sidewall 13 of the base 9 can abut the endwall 19 of the cover 11. Suitable fasteners 23 are provided to detachably connect the cover 11 to the base 9. The base 9 itself is adapted to be mounted on a vertical, support wall 31 with its first endwall 15 flush against the support wall 31. Suitable fasteners 33 pass through openings 35 in the endwall 15 to fasten the base 9 to the wall 31.

The dispenser also has a spindle 37 within the housing 7 on which the roll 3 is adapted to be mounted. The spindle 37 is centrally, rotatably mounted on the endwall 15 of the base 9 and extends transversely therefrom toward the cover 11. The spindle 37, as shown in FIG. 3, can have a socket 39 at its inner end 41. The spindle 37 is rotatably mounted, via socket 39, on a stub shaft 43 projecting transversely from the endwall 15 of the base 9. A circular bead 45 on the stub shaft 43 fits in a circular groove 47 within the socket 39 to hold the spindle 37 on the stub shaft 43. The wall 49 of the spindle 37 defining the socket 39 can be slotted as shown at 51 from the inner end 41 forming resilient wall sections 53 to allow mounting of the spindle 37 on the shaft 43. The spindle can be easily mounted, and replaced if needed. The spindle 37 projects through a central hole 55 in the endwall 19 of the cover 11. The projecting outer end 57 of the spindle 37 can be grasped and manually rotated to rotate the roll 3 on the spindle 37 and to thus unwind toilet paper 5 off the roll.

The roll 3 is mounted on the spindle 37, within the base 9, with the cover 11 removed. Once the roll is in place, the cover 11 is connected to the base 9 with the fasteners 23. The sides 59, 61 of the mounted roll 3 lie closely adjacent to the parallel first and second endwalls 15, 19 of the base 9 and cover 11 respectively.

An outlet opening 63 is provided in the housing 7 through which the toilet paper 5 is dispensed. The outlet opening 63 is in the sidewall 13 of the base 9 and extends over an arc of about 50° in the bottom portion of the sidewall 13 when the base 9 is mounted on the support wall 31. The length of the opening 63 can vary but normally is made just large enough to comfortably receive an open hand reaching for the paper. The outlet opening 63 is generally rectangular in shape as shown in FIG. 4 with one side 65 of the opening adjacent and parallel to the first endwall 15 of the base.

The other side 67 of the opening is located inwardly of the second endwall 19, and the outer side 61 of the roll mounted on the spindle. In this embodiment the side 67 of the opening is adjacent and parallel to the free edge 69 of the sidewall 17 of the cover 11. Also, the width Wo. of the opening 63 is noticeably less than the width Wp of the toilet paper.

As the toilet paper 5 is pulled off the roll 3, it is normally pulled away from the wall 31 as shown in FIG. 5, causing the inner side 75 of the paper to fold over on itself along a first fold line 77. The location of the other side 67 of the opening 63, inwardly of second endwall 19, causes it to fold over the outer side 79 of the paper 5 on itself forming a second fold 81 in the sheet as it is being pulled off the roll 3. The twice-folded over paper 5 is much stronger than a once-folded over paper thereby minimizing inadvertent tearing of the paper while pulling it off the roll.

It has been found that the toilet paper 5 often bunches or gathers in one of the two outer corners of the opening 63 while being pulled off the roll 3. This is probably due to the paper being pulled both downwardly, and outwardly away from the support wall 31 during dispensing. The bunched or gathered paper is awkward to tear. In accordance with the present invention, the outer corners of the opening 63, adjacent the side 67, are gently rounded as shown at 85 in FIG. 4. The rounded corners 85 spread out the paper so that it does not gather or bunch as much as in an angular corner. In addition the spread-out paper is easier to tear. To facilitate tearing of the paper in the corners 85, the corners are preferably serrated providing cutting teeth 87.

Figure 6:
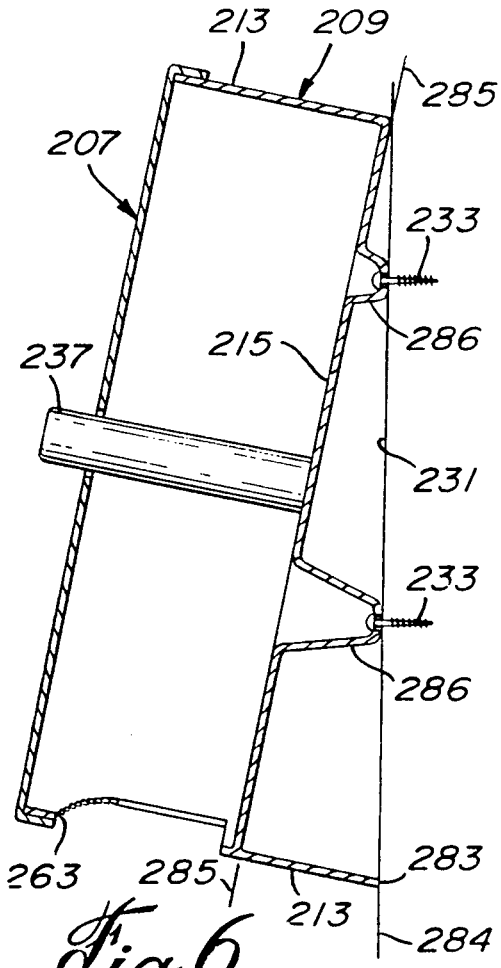
FIG. 6 is a cross-sectional view of a further embodiment of the toilet paper dispenser.

In an alternative construction, the dispenser can be constructed so as to slant away from the support wall. As shown in FIG. 6, the base 209 of the housing 207 has a sidewall 213 that is wider at the bottom than at the top and that projects rearwardly past the endwall 215. The free inner edge 283 of the sidewall 213 lies in a plane 284 that diverges slightly inwardly from the plane 285 that contains the endwall 215. The plane 284 preferably crosses the plane 285 at the top of the base although it could cross above the base as well. The sidewall 213 effectively moves the outlet opening 263 well away from the support wall 231 when the base is mounted on the wall 231 with the free edge 283 of the sidewall 213 abutting the wall 231. The endwall 215 can have projections 286 formed therein extending rearwardly to terminate in the plane 284. Holes in the bottom of the projections 286 allow fasteners 233 to connect the base 209 to the wall 231.

Figure 7:
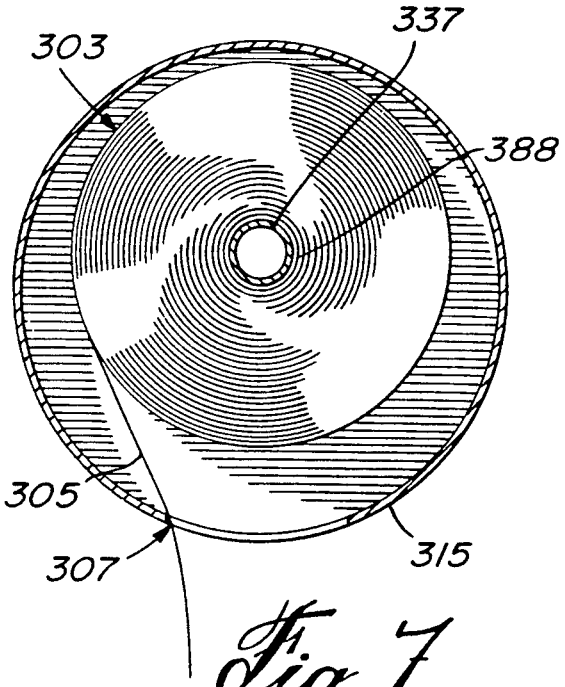
FIG. 7 is a cross-sectional view of another embodiment of the toilet paper dispenser.

In another embodiment of the invention, the spindle 37 can be eccentrically mounted on the endwall 15 of the base 9. As shown in FIG. 7 the spindle 337 is mounted slightly above the center 388 of the endwall 315. This provides more room at the bottom of the housing 307 for the paper 305 to slide away from the roll 303 making dispensing easier.

Figure 8:
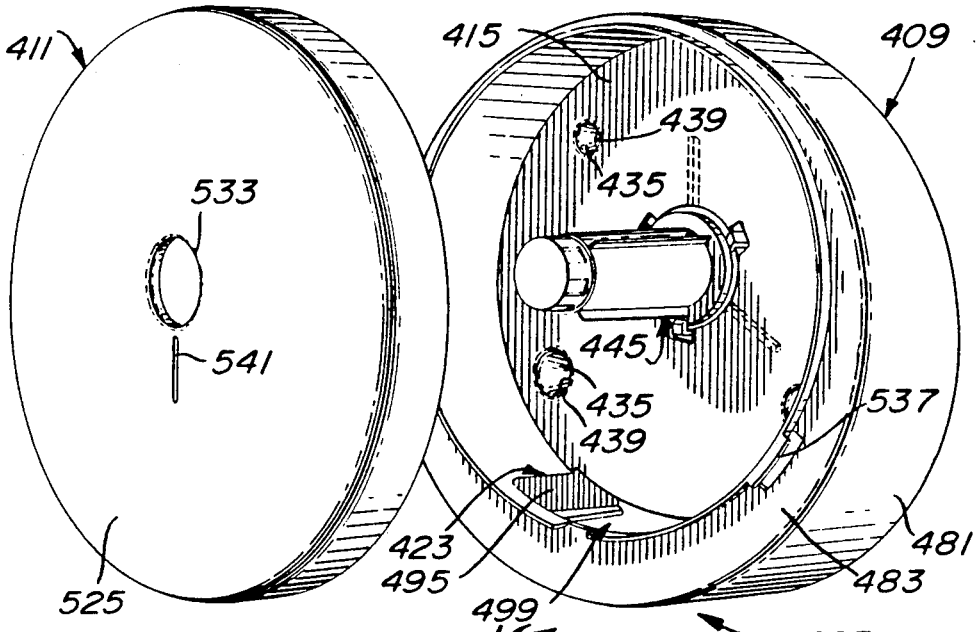
FIG. 8 is an exploded perspective view of the preferred embodiment of the dispenser.
Figure 9:
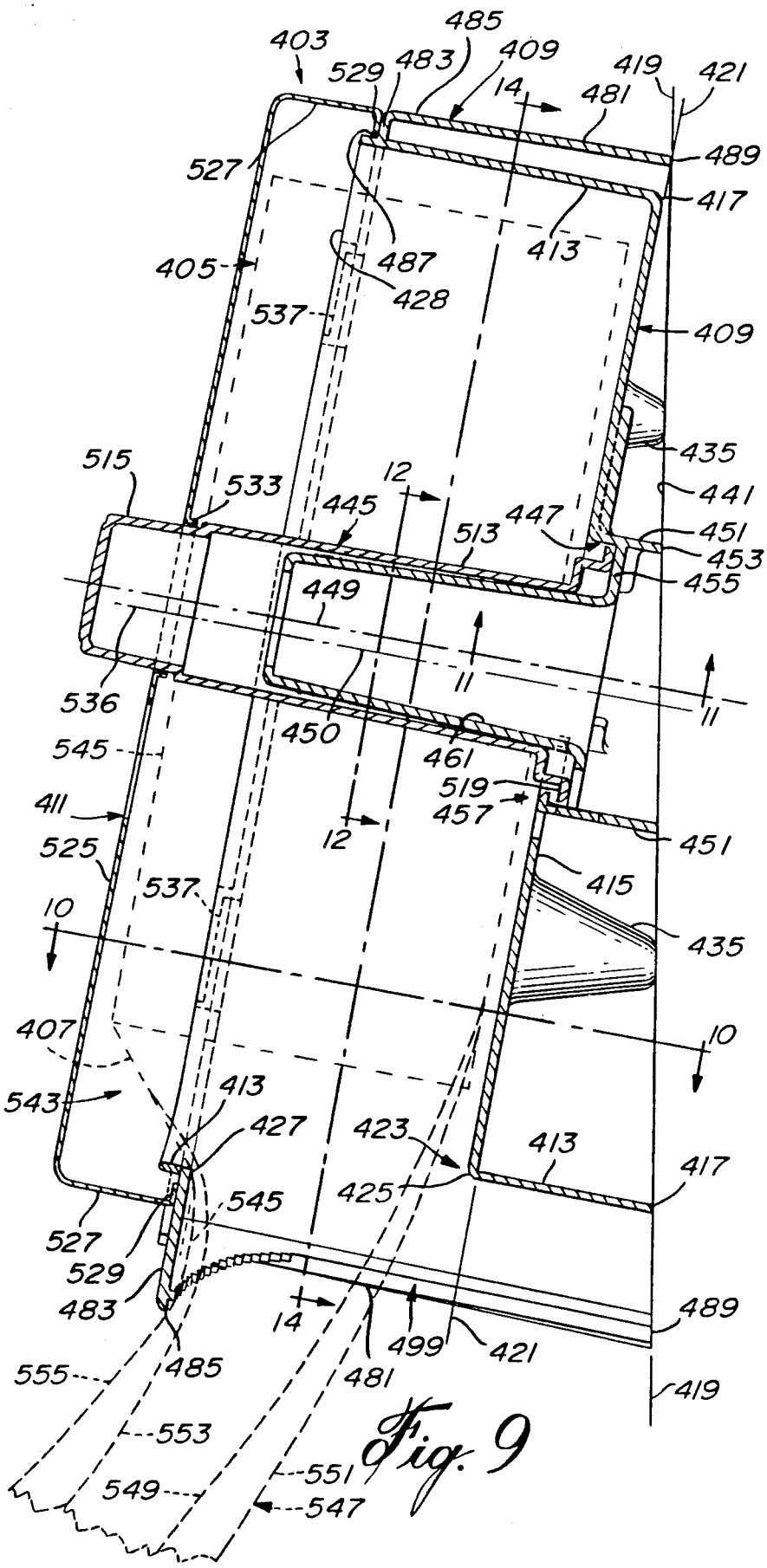
FIG. 9 is a cross-sectional view of the dispenser of FIG. 8 mounted on a wall.

In a preferred embodiment of the invention, as shown in FIGS. 8 and 9, the dispenser includes a housing 403 for holding a large roll 405 of toilet paper 407. The housing 403 is in two sections and has a base 409 and a removable cover 411. The base 409 has an inner curved sidewall 413 and a first flat endwall 415. The inner sidewall 413 is preferably cylindrical and the endwall 415 is circular and closes one side of the sidewall. The sidewall 413 extends rearwardly of the endwall 415 with its inner end edge 417 lying in a plane 419 that diverges from the plane 421 containing the endwall 415. The plane 419 crosses the plane 421 just above the top of the endwall 415.

Figure 10:
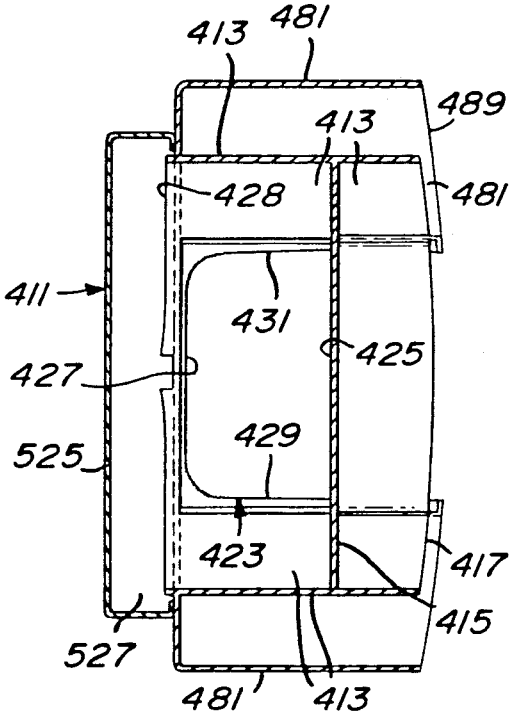
FIG. 10 is a partial cross-sectional view taking along line 10—10 in FIG. 9.

An inner outlet opening 423 for the paper 407 is provided in the bottom of the sidewall 413 as shown in FIG. 10. The opening 423 extends over an arc of about 50° and is generally rectangular in shape. The inner side 425 of the inner opening 423 is generally aligned with the endwall 415 and the outer side 427 can coincide with the outer free edge 428 of the sidewall 413. The ends 429, 431 of the opening extend between and transverse to the sides 425, 427.

Fastener projections 435 are provided at spaced locations in the end wall 415 extending to the imaginary plane 419. The projections are conical in shape with holes at the bottom of the depressions to allow fasteners 439 to pass through to secure the base 409 to a vertical support wall 441 with the inner end edge 417 of the inner sidewall 413 abutting the wall 441 and the opening 423 facing downwardly.

Figure 11:
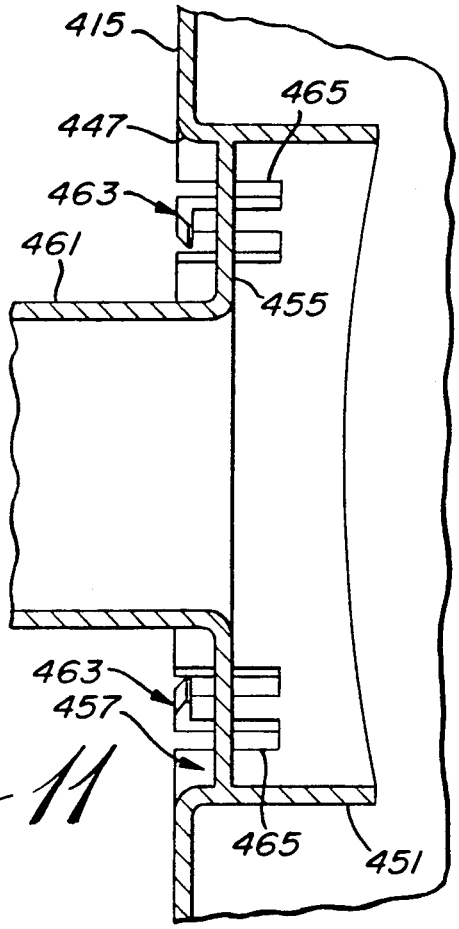
FIG. 11 is a cross-sectional view taken along line 11—11 in FIG. 9 without the spindle.
Figure 12:
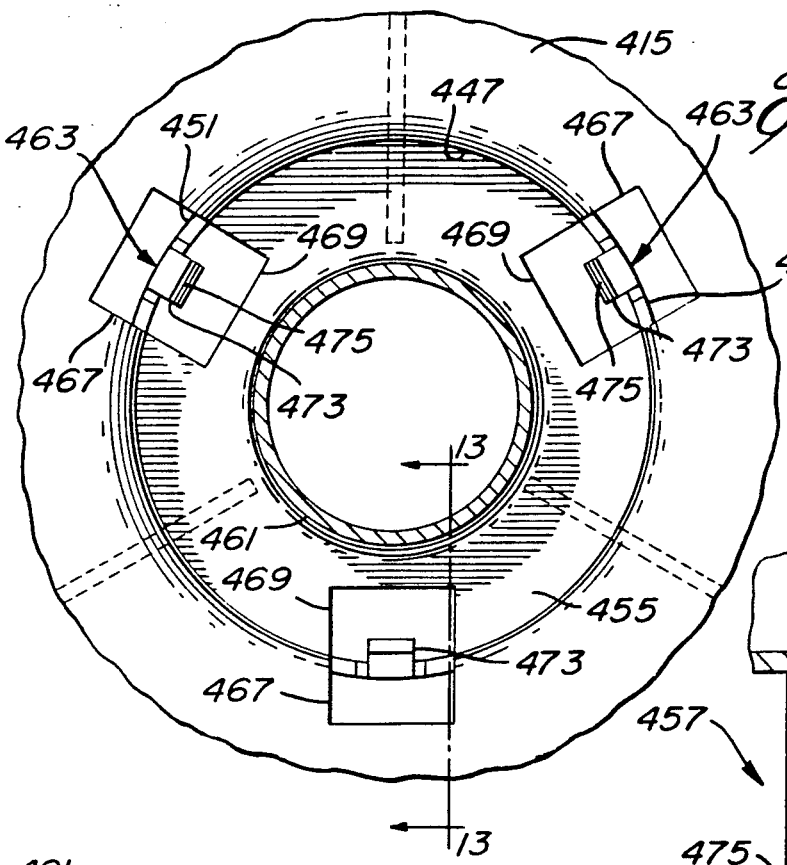
FIG. 12 is a cross-sectional view taken along line 12—12 in FIG. 9 without the spindle.
Figure 13:
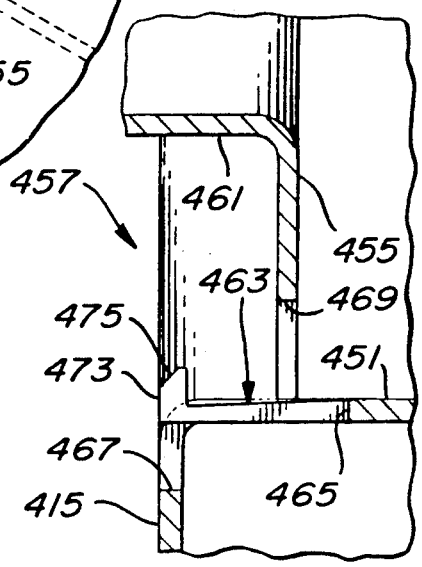
FIG. 13 is a cross-sectional view taken along line 13—13 in FIG. 12.

Means for mounting a spindle 445 are integrally provided in the endwall 415. The spindle mounting means as shown in FIGS. 11 and 12 includes a circular hole 447 in the endwall 415 the center 449 of which is located a short distance above the center 450 of the circular endwall 415 as shown in FIG. 9. A cylindrical wall 451 surrounds the hole 447 extending rearwardly from the endwall 415. The rear free edge 453 of the wall 451 preferably lies in the plane 417. A bottom wall 455 extends across the cylindrical wall 451 a short distance rearwardly of the end wall 415 forming a shallow depression 457 to receive the spindle 445. A spindle mounting shaft 461 extends up from the center of the bottom wall 455. Resilient fingers 463 are formed in the cylindrical wall 451 extending upwardly in cutouts 465 to the endwall 415. Three such fingers, equally spaced apart, are provided. Cutouts 467 in the endwall 415 and cutouts 469 in the bottom wall 455 are radially aligned and integral with cutouts 465. Each finger 463, as shown in FIG. 13, has a radially inwardly extending hook 473 at its free end. The outer, upper surface of each hook 473 is bevelled as shown at 475 forming a cam surface. The resilient fingers 463, through the hooks 473, hold the spindle 445 in place as will be described.

Figure 14:
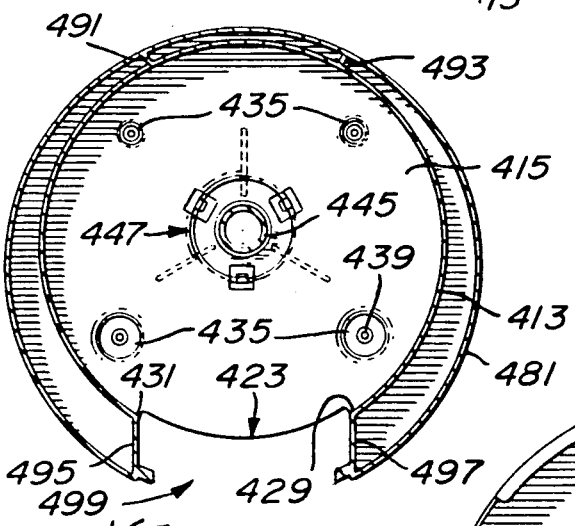
FIG. 14 is a cross-sectional view of the base of the dispenser taken along line 14—14 of FIG. 9.
Figure 15:
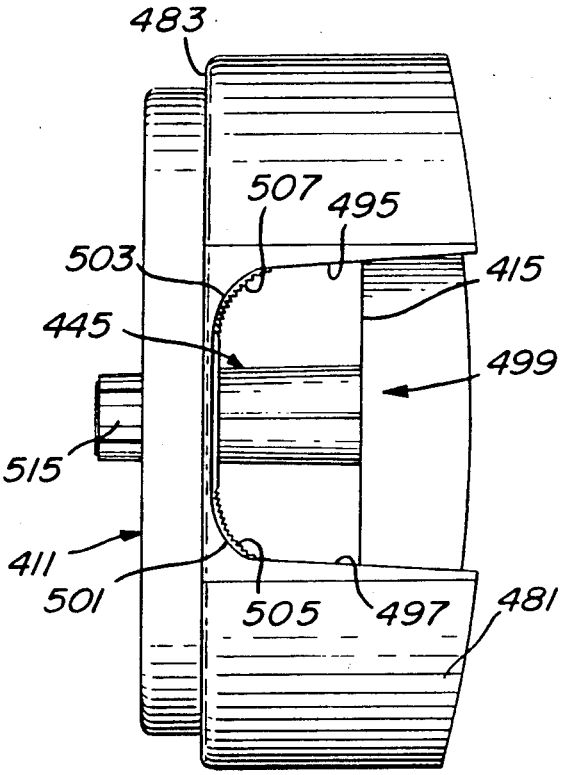
FIG. 15 is a bottom view of the dispenser.

The base 409 is also provided with an outer curved sidewall 481 as shown in FIGS. 8 and 9. This sidewall 481 is also circular and surrounds the inner sidewall 413. The outer sidewall 481 is eccentric with respect to the inner sidewall 413 being close to the inner sidewall 413 at the top of the base 409 and being farther away from the inner sidewall 413 at the bottom of the base. A front wall 483 joins the outer sidewall 481 at its outer edge 485 to the inner sidewall 413. The front wall 483 is parallel to the endwall 415 and is joined to the inner sidewall 413 a short distance inwardly of its outer edge 428. The inner free edge 489 of the outer sidewall 481 lies in the imaginary plane 419. Stiffening members also connect the inner and outer sidewalls 413, 481 of the base 409 together. Two stiffening members, 491, 493 are provided at the top of the base 409, circumferentially spaced apart as shown in FIG. 14. Two stiffening members 495, 497 are provided at the bottom of the base 409. The bottom stiffening members 495, 497 extend downwardly from the ends 429, 431 of the inner outlet opening 423 in the inner sidewall 413. The bottom stiffening members 495, 497 also define the sides of an outer outlet opening 499 formed in the outer sidewall 481. This outer outlet opening 499 extends across the full width of the outer sidewall 481 as shown in FIG. 15 and is aligned with the inner outlet opening 423 in the inner sidewall 413. The bottom edges of the bottom stiffening members 495, 497 form cutting edges for toilet paper dispensed through the aligned inner outer outlet openings 423, 499. The outer sidewall 481 can be extended into the bottom outlet opening 499 to form rounded corners 501, 503 adjacent the front wall 483. The corners 501,503 can be serrated to provide cutting teeth 505, 507. The outer sidewall 481 locates the cutting edges for the toilet paper some distance below the inner sidewall 413. With the front wall 483 of the dispenser made of clear, transparent material the user can easily see where the end of the toilet paper is located.

Figure 17:
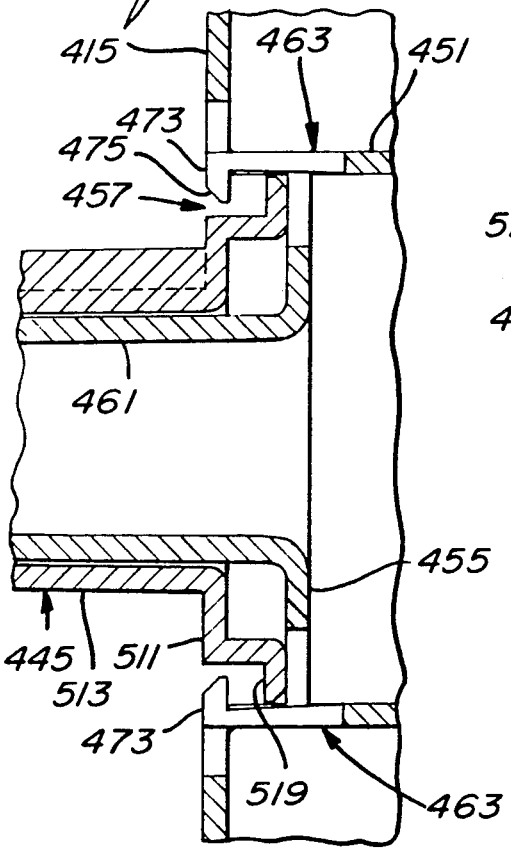
FIG. 17 is a detailed cross-sectional view of the spindle mounting.
Figure 16:
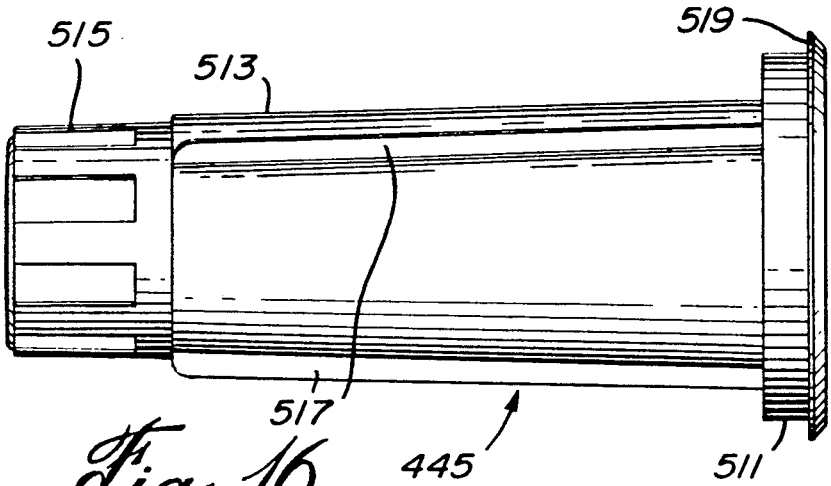
FIG. 16 is a side view, in partial cross-section, of the spindle.

The dispenser has a spindle 445 detachably mounted in the housing 403. The spindle 445 has a narrow cylindrical base 511 as shown in FIG. 16 with a long, cylindrical stem 513 extending outwardly from the center of the base 511. The stem 513 terminates in a relatively short, cylindrical handling portion 515. Longitudinal ribs 517, circumferentially spaced apart, are provided on the stem 513. A thin, integral mounting flange 519 extends radially outwardly from the bottom of the base 511. The spindle is hollow. The spindle 445 is mounted onto the base 409 by moving it over and down on the spindle mounting shaft 461. As the spindle 445 reaches the depression 457 in the endwall 415, the flange 519 contacts the cam surfaces 475 on the resilient fingers 463 pushing them outwardly. As the flange 519 passes past the hooks 473 on the fingers 463, the fingers 463 snap back with the hooks 473 resting on top of the flange 519 to detachably hold the spindle 445 in place as shown in FIG. 17. The spindle 445 is rotatable while mounted. The resilient fingers 463 allow the spindle 445 to be easily replaced if needed, after the cover 411 has been removed.

Figure 18:
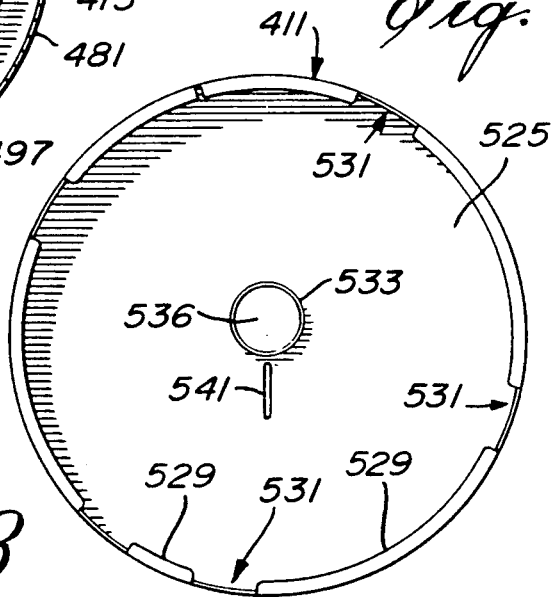
FIG. 18 is a back view of the cover.

The cover 411 has a circular second endwall 525 and a relatively narrow cylindrical sidewall 527 extending transversly to the second endwall 525 about its periphery. A narrow inturned rim 529 extends radially inwardly from the other side of the sidewall 527. The rim 529 is parallel to the endwall 525. Gaps or notches 531 are provided in the rim 529 equally spaced apart about its periphery as shown in FIG. 18. The cover 411 has a circular spindle hole 533 in the endwall 525 offset a short distance from the center 536 of the endwall 525. Center 536 of endwall 525 coincides with center 449 of endwall 415.

The cover 11 is sized to be mounted on the inner sidewall 413, over that portion of the inner sidewall 413 that projects forwardly of the front wall 483 as shown in FIG. 9. Outwardly radially extending lugs 537 are provided on the inner sidewall 413 adjacent its outer edge 428 as shown in FIGS. 8 and 9. The cover 411 is rotatably positioned to have its central spindle hole 533 aligned with spindle 445 and its gaps 531 aligned with the lugs 537. The cover 411 is then pushed over the outer edge 487 of the inner cylindrical wall 413 with its rim 529 abutting against the front wall 483 and with the handling portion 515 of the spindle projecting through the hole 533. The cover 411 is then rotated slightly to lock the rim 529 behind the lugs 537. The cover 411 can be provided with a slot 541 to permit a visual check of the roll 405 to determine if it requires replacing.

With the cover 411 in place, an enclosed space 543 is provided in the housing 403 between the endwall 415 of the base 409 and the endwall 525 of the cover 411 that is just wide enough to accommodate the toilet paper roll 405 as shown in FIG. 9. It will be seen that a portion of the roll 405 is accommodated within the depth of cover 411. The inner outlet opening 423 however, is noticeably narrower than the width of the enclosed space 543. The outer side 427 of the opening 423 is spaced some distance inwardly of the endwall 525 of cover 411 and of the outer side 545 of roll 405. When the paper 547 is pulled off the roll 405, it is normally pulled off at an angle away from the wall 419 as shown in FIG. 9. This causes the inner side 549 of the paper to fold over along a first fold line 551. The outer side 427 of the opening 423 also causes the outer side 553 of the paper to fold over along a second fold line 555. The twice-folded sheet is quite strong permitting thinner paper to be used.

The rounded corners 501, 503 in the bottom outlet opening 499 as shown in FIG. 15, spread out the paper if it has a tendency to bunch in the corner and the teeth in the corner help to tear the paper. The base 409 is mounted flush against support wall 441 but the inner and outer outlet openings 423, 499 are spaced from the support wall 441 because of the rearwardly extending portions of the sidewalls 413, 481. The handling portion 515 of the spindle 445 is accessible outside of the cover 411 allowing the spindle to be rotated manually to dispense paper. Mounting the spindle 445 in a raised eccentric position relative to the cylindrical closed space 543 within the housing gives more room at the bottom for paper to slide off the roll, making dispensing easier.

I claim:

1. A dispenser for a roll of toilet paper having a housing with parallel endwalls and a sidewall joining the endwalls together, means on one endwall for use in mounting the housing on a vertical surface, a spindle within the housing mounted on one endwall, means on the housing permitting a roll of toilet paper to be mounted within the housing on the spindle, an outlet opening in the sidewall located at the bottom of the housing when it is mounted on the vertical surface, the opening large enough to receive a hand and having a width less than the width of the toilet paper, one side edge of the opening being parallel to, but spaced inwardly from the other endwall to cause the toilet paper to be at least partly folded over on itself by the one side edge as it is dispensed from the housing through the opening.

2. A dispenser as claimed in claim 1 including parallel end edges extending transversely from the side edge in defining the opening, gently rounded corners where each end edge joins the side edge and teeth on each corner for severing the toilet paper as it is pulled out of the opening against either corner during dispensing from the housing.

3. A dispenser as claimed in claim 1 wherein the mounting means includes an extension of the sidewall past the one endwall, the extension of the sidewall ending in a free edge that lies in an imaginary plane that extends at a small angle to the imaginary plane containing the one endwall so as to position the outlet opening away from the vertical surface the housing is mounted on.

4. A dispenser as claimed in claim 1 including integral mounting means on the one endwall and on the spindle for use in detachably connecting them together.

5. A dispenser as claimed in claim 1 wherein the spindle is mounted on the first endwall and extends through the second endwall so that its projecting portion can be manually manipulated to rotate the spindle to dispense toilet paper off the roll.

6. A dispenser as claimed in claim 1 wherein the endwalls are circular and the spindle is mounted on the one endwall at a location slightly spaced from the center of the one endwall and diametrically opposite the center of the outlet opening.

7. A dispenser as claimed in claim 4 wherein the mounting means on the one endwall includes a shallow depression for receiving the base of the spindle and resilient fingers for holding the base of the spindle in the depression.

8. A dispenser for a roll of toilet paper having a housing; the housing having a base with a first endwall and a first sidewall extending transversely therefrom, means on the base for use in mounting the housing on a vertical surface, a second sidewall encircling the first sidewall and joined thereto by a front wall that is parallel with the first endwall; the housing having a cover with a second endwall and a sidewall extending transversely therefrom; means detachably connecting the cover to the base with the sidewall of the cover abutting the front wall of the base; a spindle within the housing mounted on the first endwall for receiving the roll which is located within both the base and the cover; a first outlet opening for the toilet paper located in the bottom of the first sidewall when the housing is mounted on the vertical surface; a second outlet opening in the bottom of the second sidewall beneath and generally aligned with the first outlet opening, the second outlet opening having an outer side edge that is parallel with the front wall and that is located inwardly of the outer side of the toilet paper roll when it is mounted on the spindle to cause the toilet paper to be at least partly folded over on itself by the outer side edge as it is dispensed from the housing through the openings.

9. A dispenser as claimed in claim 8 including parallel end edges extending transversely from the outer side edge in the second outlet opening, gently rounded corners where each end edge joins the outer side edge, and teeth on each corner for serving the toilet paper as it is pulled out of the opening against either corner during dispensing from the housing.

10. A dispenser as claimed in claim 8 wherein the first sidewall is circular, and the second sidewall is circular and eccentric with respect to the first sidewall, the second sidewall being farthest away from the first sidewall at the bottom of the housing when the housing is mounted on the vertical surface.

11. A dispenser as claimed in claim 8 wherein the mounting means includes an extension of the second sidewall one the base past the first endwall, the extension of the second sidewall ending in a free edge that lies in an imaginary plane that extends at a small angle to the imaginary plane containing the first endwall so as to position the outlet openings away from the vertical surface the housing is mounted on.

12. A dispenser as claimed in claim 8 wherein the spindle extends through the second endwall in the cover so that its projecting portion can be manually manipulated to rotate the spindle to dispense toilet paper off the roll.

13. A dispenser as claimed in claim 8 wherein the front wall is transparent.

14. A dispenser as claimed in claim 8 wherein the endwalls are circular and the spindle is mounted on the first endwall at a location slightly spaced from the center of the first endwall and diametrically opposite the center of the outlet opening.

* * * * *